United States Patent [19]

Tatsumi

[11] Patent Number: 4,844,634

[45] Date of Patent: Jul. 4, 1989

[54] PRINTING HEAD FOR AN IMPACT PRINTER

[75] Inventor: Juichi Tatsumi, Tokorozawa, Japan

[73] Assignee: Ye Data Inc., Tokyo, Japan

[21] Appl. No.: 194,261

[22] Filed: May 16, 1988

[30] Foreign Application Priority Data

Jul. 27, 1987 [JP] Japan ..... 62-185391
Jul. 27, 1987 [JP] Japan ..... 62-185392
Jul. 27, 1987 [JP] Japan ..... 62-185393

[51] Int. Cl.[4] ..... B41J 3/02; B41J 3/10; B41J 9/36; H01F 7/04

[52] U.S. Cl. ..... 400/121; 101/93.04; 101/93.48; 400/157.2

[58] Field of Search ..... 400/121, 124, 157.1, 400/157.2; 310/317; 101/93.48, 93.04

[56] References Cited

U.S. PATENT DOCUMENTS

| | | | |
|---|---|---|---|
| 3,090,297 | 5/1963 | Wilkins et al. | 101/93.03 |
| 3,828,908 | 8/1974 | Schneider | 400/124 |
| 4,244,658 | 1/1981 | Mori | 400/124 |
| 4,393,771 | 7/1983 | Tatsumi | 400/124 X |
| 4,593,658 | 6/1986 | Moloney | 310/317 |

FOREIGN PATENT DOCUMENTS

| | | | |
|---|---|---|---|
| 3329896 | 3/1985 | Fed. Rep. of Germany | 400/124 |
| 48-81611 | 11/1973 | Japan . | |
| 55-51568 | 4/1980 | Japan . | |
| 115359 | 7/1982 | Japan | 400/121 |
| 162351 | 9/1983 | Japan | 400/121 |
| 83674 | 5/1984 | Japan | 400/124 |
| 103766 | 6/1984 | Japan | 400/124 |
| 150756 | 8/1984 | Japan | 400/124 |
| 60-50152 | 11/1985 | Japan . | |
| 62-3231 | 1/1987 | Japan . | |

OTHER PUBLICATIONS

IBM Technical Disclosure Bulletin, "No-Work-Type Actuator With Laminated PZT Beam Spring", by Lane et al., vol. 27, No. 2, Jul. 1984, pp. 1105–1108.

*Primary Examiner*—Edgar S. Burr
*Assistant Examiner*—Moshe L. Cohen
*Attorney, Agent, or Firm*—Wenderoth, Lind & Ponack

[57] ABSTRACT

A spring-charge type printing head has an elongatable support including a piezoelectric element provided between an attracting permanent magnet and a hammer-fixing portion. Accordingly, the printing head can be operated at a high speed and require less power than a conventional device.

6 Claims, 3 Drawing Sheets

PRINTING HEAD FOR AN IMPACT PRINTER

BACKGROUND OF THE INVENTION

1. Field of the Invention

The present invention relates to a spring-charge type printing head for a dot impact printer.

2. Description of the Prior Art

A conventional spring-charge type printing head for a dot impact printer comprises, as shown in Fig;. 1, a hammer 1 having a plate spring 1*b* with a hammer pin 1*a* provided on one end thereof, the other end being secured to a yoke 5, an electromagnetic coil 3 mounted on a core 2, and a permanent magnet for attracting the hammer 1 to the core at a standby position, wherein during printing, the electromagnetic coil 3 is energized to demagnetize a magnetic field produced by the permanent magnet 4 and the hammer pin 1*a* is sprung forward under theforce of the plate spring 1*b* to effect printing.

The relationship between the displacement of the hammer pin 1*a* to the force in this case is shown in FIG. 2.

When the electromagnetic coil 3 is deenergized, the hammer 1 is attracted toward the core by means of attraction energy represented by B in FIG. 2, thereby returning to the standby position.

Since in the conventional method, the magnetic characteristic is varied to carry out the printing operation, an electric delay poses a limit on effecting a higher speed operation. Furthermore, in the conventional system, the printing speed is limited in order to prevent overheating of the electromagnetic coil.

Moreover, in the conventional printing head as shown in FIG. 3, when the hammer 1 impinges against core 2, a rebound phenomenon arises resulting in a secondary oscillation mode, and as a result, the attenuation time of the hammer due to the rebound phenomenon is relatively long and the time required to print becomes considerably longer than the normal flying time of the hammer, thereby inhibiting the ability of the device to effect a higher speed operation. Furthermore, noise occurs because of the rebound phenomenon, and the hammer 1 is slidably moved in a direction as indicated by the arrow relative to the core 2, thus posing a problem in that the hammer and core wear.

SUMMARY OF THE INVENTION

It is a first object of the present invention to provide a spring-charge type printing head for an impact printer which can achieve a relatively high speed operation.

It is a second object of the invention to provide a printing head capable of performing at a high speed and continuously without suffering from a problem associated with self-generation of heat.

It is another object of the invention to provide a printing head which can suppress the rebound phenomenon experienced when the hammer is attracted toward the core after printing to allow high-speed operation and which can minimize the wear caused by the contact between the hammer and the core to enhance durability and reduce noise.

It is yet another object of the invention to provide a printing head to which miniaturization of the printer and a relatively low cost thereof can be attributed.

DETAILED DESCRIPTION OF THE PREFERRED EMBODIMENTS

Figure 4:
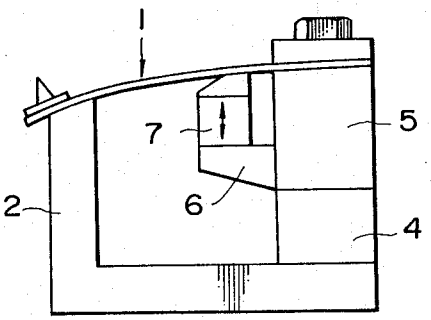
FIG. 4 is a side view of one embodiment of a printing head according to the present invention.

FIG. 4 shows an embodiment of the present invention in which reference numeral 1 designates a hammer in the form of a plate spring 1*b* provided at one end with a hammer pin 1*a* and having the other end thereof secured to a yoke 5, reference numeral 4 designates a hammer-attracting permanent magnet supporting the yoke 5, and reference numeral 6 designates an arm supporting an elongatable piezoelectric element 7.

It is noted that the piezoelectric element 7 can be elongated in the direction indicated by the arrow when a voltage is applied thereto.

Figure 5:
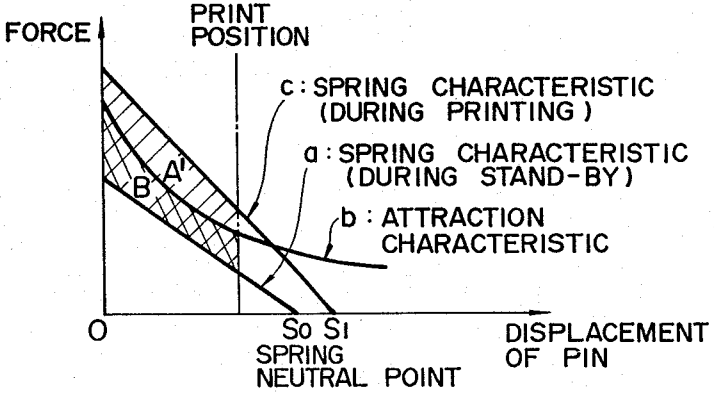
FIG. 5 shows the relationship between displacement of a hammer pin in the embodiment according to the present invention shown in FIG. 4 to the force exerted thereby.

FIG. 5 shows the characteristic of hammer pin displacement-force in this embodiment. Reference character a represents the spring characteristic of a plate spring 1*b* when in a standby position, reference character b represents the characteristic of attraction force produced by the permanent magnet 4, and reference character c represents the spring characteristic of the plate spring 1*b* during printing.

When a voltage is applied to the piezoelectric element 7, the element 7 elongates to raise the hammer spring 1*b* and change the spring neutral point of the plate spring from $S_0 \rightarrow S_1$ thereby effectively changing the spring constant, whereby the spring characteristic of the plate spring 1*b* is as shown at c, and the hammer pin 1*a* is sprung forward by the energy represented by A' in FIG. 5 to effect printing.

When the electric field imparted to the piezoelectric element 7 is opened, the spring neutral point of the plate spring and the spring constant are returned to their original state, and then the hammer 1 is attracted toward the core by the attraction energy represented by B, returning to the standby position.

Figure 6:
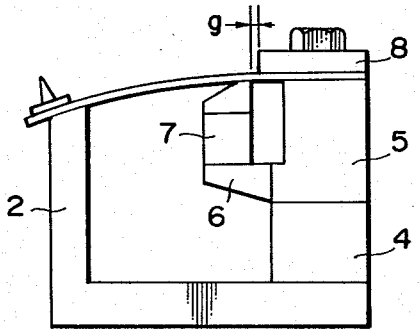
FIGS. 6 and 7 are, respectively, side views of other embodiments of the present invention.

FIG. 6 shows another embodiment, which is different from that shown in FIG. 4 in that a lift-point adjusting plate 8 is provided.

When the lift-point adjusting plate 8 is provided to make a gap g small, the spring neutral point and the spring constant can be changed to a great degree and therefore, the printing head can exhibit superior responsiveness even if the dimensions are the plate spring 1*b* are not precise.

Figure 7:
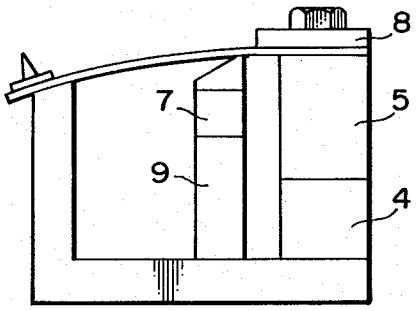

FIG. 7 shows another embodiment of the present invention, in which a support 9 provided with the piezoelectric element is columnar instead of being an arm, as shown in FIGS. 4 and 6.

While in the embodiment the entire hammer has been made of a plate spring, it is to be noted that the present invention can be applied to a hammer in which a beam having a hammer pin is mounted on the end thereof.

As will be understood from the description of the above-described embodiments, according to the present invention, substantially high-speed operation cannot only be achieved due to the high-speed responsiveness of the piezoelectric element but there is no self-generation of heat since no electromagnetic coil is provided, and thus, a small printing head capable of performing high speed continuous printing can be realized. Moreover, since the power for driving the piezoelectric element is small, not only can the power source be relatively compact and inexpensive but the amount of heat generated in the entire printer can be relatively small, thus being contributing factors in realizing a small and low-cost printer.

Figure 1:
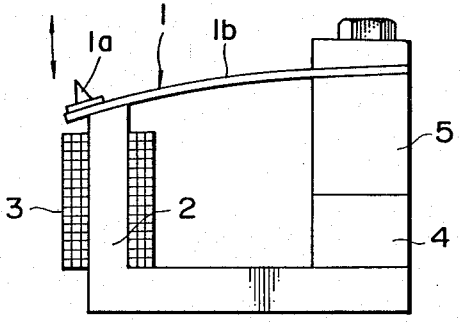
FIG. 1 PRIOR ART
FIG. 1 is a side view of a conventional printing head.
Figure 2:
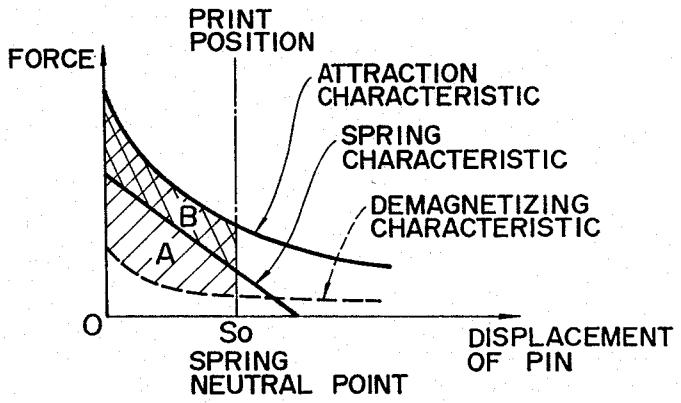
FIG. 2 PRIOR ART
FIG. 2 shows the relationship between displacement of the conventional hammer pin shown in FIG. 1 to the force exerted thereby.

While in the above-described three embodiments according to the present invention, no demagnetizing electromagnetic coil has been provided, it is to be noted that the elongatable support can be effectively used even when a demagnetizing electromagnetic, as in the conventional type shown in FIG. 1, is used thus effecting the high speed responsiveness and the capability of the device to suppress the rebound phenomenon.

The second and third embodiments will be described hereinafter.

Figure 8:
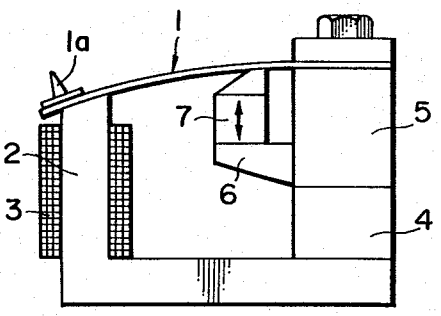
FIG. 8 is a side view of another embodiment according to the present invention.

FIG. 8 shows an embodiment of a printing head according to the present invention, which is different from that shown in FIG. 4 in the addition of a demagnetizing electromagnetic coil 3.

Figure 9:
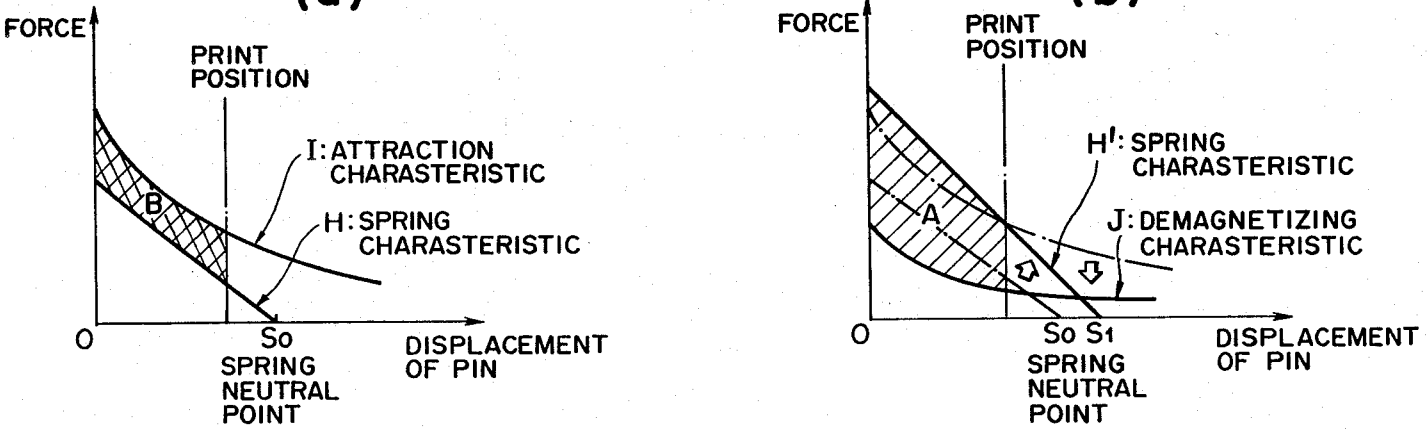
FIGS. 9(*a*) and 9(*b*) show the relationship between displacement of the hammer pin in the embodiment of the present invention shown in FIG. 8 to the force exerted thereby.
Figure 3:
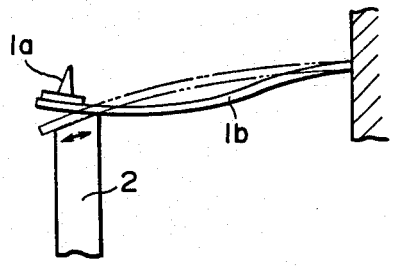
FIG. 3 shows a rebound state of the conventional hammer shown in FIG. 1.

FIG. 9 shows the characteristic of displacement of a hammer pin-force in this embodiment. FIG. 9(*a*) shows the characteristic of hammer pin displacement-force during when the hammer pin is in a standby position; and, FIG. 9(*b*) shows the characteristic of hammer pin displacement-force during printing, reference characters H, H' designating the spring characteristic of the plate spring, I the effect of the attraction force produced by the magnet and J the demagnetizing effect of the electromagnetic coil.

In the printing head shown in FIG. 8, when the electromagnetic coil 3 is energized to demagnetize the magnetic field caused by the permanent magnet and voltage is applied to the piezoelectric element 7, the element 7 elongates to raise the hammer spring 1*b* and changes the spring neutral point from $S_0 \rightarrow S_1$ as shown in FIG. 4(*b*) and to effectively change the spring constant whereby the spring characteristic of the plate spring 1*b* is as shown in H', and the hammer pin 1*a* is sprung forward by printing energy represented by A in FIG. 9(*b*) to effect printing.

When the electromagnetic coil 3 is deenergized and the electric field imparted to the piezoelectric element 7 is opened, the spring neutral point of the plate spring is returned to the position $S_0$ and the spring constant returns to the original one, or H, as shown in FIG. 9(*a*), and this time, the hammer 1 is attracted toward the core by the attraction energy represented B, returning to the standby position.

According to the present invention, the printing energy represented by A in FIG. 9(*b*) can be increased, and therefore a higher speed operation can be achieved, and in addition, since the current flowing through the electromagnetic coil can be decreased while increasing the printing energy as compared with the conventional method, it is possible to realize, as compared to the conventional device, a low-cost printing head capable of performing continuous printing with less heat generation.

Moreover, when applying voltage to the piezoelectric element 7, if a high voltage (controlled and determined experimentally) for suppressing the rebound phenomenon, normally occuring when the hammer is returned, is applied, it is possible to suppress the rebound phenomenon, minimize noise generation and remarkably reduce the wear of the hammer and core.

Figure 10:
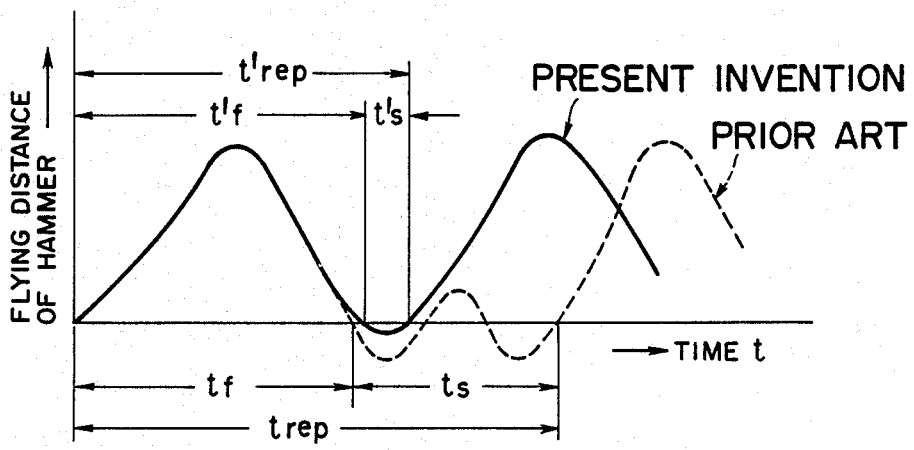
FIG. 10 shows the operating characteristics of tips of hammer pins of the embodiment shown in FIG. 8 and in the prior art shown in FIG. 1, respectively.

FIG. 10 shows the dynamic characteristic of the tips of hammer pins. In the prior art, the attenuation time $t_s$ of the hammer attributed to the rebound phenomenon is relatively long and the printing period $t_{rep}$ is considerably longer than the flying time $t_f$. On the other hand, in the present invention, $t'_s$ is relatively small and the printing period $t'_{rep}$ is relatively short and thus high-speed operation is effected.

Furthermore, the rebound phenomenon is not present. The wear of the plate spring and the magnetic pole which has been considered as one of the disadvantages encountered in the prior art is insignificant, and thus, the present invention provides for an extended service life of the head.

Moreover, noise caused by the impingement of the metal surfaces of the plate spring and the magnetic pole is considerably reduced, which leads to a significant advantage for an impact printer.

Figure 11:
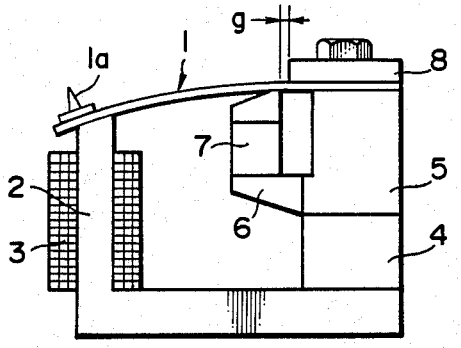
FIGS. 11 and 12 are, respectively, side views of still further embodiments according to the present invention.

FIG. 11 shows a different embodiment of a printing head with a demagnetizing electromagnetic coil according to the present invention, which is different from that shown in FIG. 6 in the provision of a lift-point adjusting plate 8.

If the lift-point adjusting plate 8 is provided to make the gap g small, the spring neutral point and the spring constant can be changed to a great degree, and therefore, the printing head can exhibit superior responsiveness even if the dimensions of the plate spring 1*b* are not precise.

Figure 12:
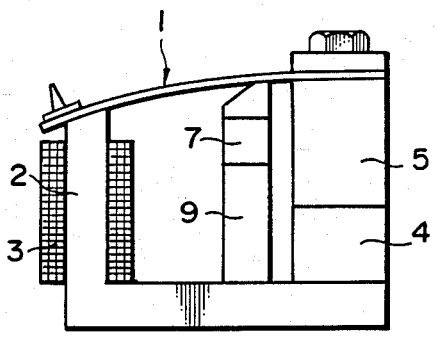

FIG. 12 shows another embodiment of a printing head with a demagnetizing electromagnetic coil according to the present invention, in which the elongatable support is columnar instead of being an arm, as shown in FIGS. 8 and 11.

While in the embodiments shown in FIGS. 8, 11 and 12, the entire hammer has been made of a plate spring, it is to be noted that the present invention can be applied to a hammer in which a fixed part comprises a plate spring and a beam having a hammer pin is mounted on the end thereof.

I claim:

1. A printing head of an impact printer, said printing head comprising:

a hammer-fixing portion, and a hammer having a first end fixed to said hammer-fixing portion and extending therefrom in a cantilever manner to a free end of the hammer, said hammer comprising a plate spring and a hammer pin extending from said free end;

a permanent magnetic means including a core adjacent the free end of said hammer, said hammer self-biased, via the spring plate thereof, away from the core, and said permanent magnet means producing a magnetic force and acts to attract the free end of said hammer toward the core against the spring force exerted by the plate spring of the hammer wherein the free end of said hammer rests against the core under the magnetic force at a standby position; and a support extending from said permanent magnet means to said hammer and contacting said hammer at a location thereon that is disposed between said hammer fixing portion and the free end of said hammer, said support having the shape of a column and including a piezoelectric element tht is elongatable, when a voltage is applied thereto, in a direction that causes said support to exert a force on said hammer in a direction that is generally opposite to the direction in which the magnetic force acts to attract the free end of said hammer toward the core, and said piezoelectric element elongatable to a degree during printing that is sufficient to cause said support to effectively change the spring constant of the plate spring of said hammer to one at which the magnetic force produced by said permanent magnet is insufficient to overcome the spring force exerted by the spring with respect to attracting the free end of said hammer to the core.

2. A printing haed of an impact printer as claimed in claim 1, wherein the location at which said support contacts said hammer is adjacent said hammer-fixing portion.

3. A printing head of an impact printer as claimed in claim 1, wherein said hammer fixing portion comprises a yoke supported on said permanent magnet means and to which yoke the first end of said hammer is secured.

4. A printing head of an impact printer, said printing head comprising:

a hammer-fixing portion, and a hammer having a first end fixed to said hammer-fixing portion and extending therefrom in a cantilever manner to a free end of the hammer, said hammer comprising a plate spring and a hammer pin extending from said free end;

a permanent magnet means including a core adjacent the free end of said hammer, said hammer self-biased, via the spring plate thereof, away from the core, and said permanent magnet means producing a magnetic force that acts to attract the free end of said hammer toward the core against the spring force exerted by the plate spring of the hammer wherein the free end of said hammer rests against the core under the magnetic force at a standby position;

an electromagnetic coil that is energizable to demagnetize said permanent magnet means; and a support extending from said permanent magnet means to said hammer and contacting said hammer at a location thereon that is disposed between said hammer-fixing portion and the free end of said hammer, said support having the shape of a column and including a piezoelectric element that is elongatable, when a voltage is applied thereto, in a direction that causes said support to exert a force on said hammer in a direction that is generally opposite to the direction in which the magnetic force acts to attract the free end of said hammer toward the core, and said piezoelectric element elongatable to a degree during printing that is sufficient to cause said support to effectively change the spring constant of the plate spring of said hammer to one at which the effects produced by the magnetic force of said permanent magnet and the degree to which the electromagnetic coil is energized are insufficient to overcome the spring force exerted by the spring with respect to attracting the free end of said hammer to the core.

5. A printing head of an impact printer as claimed in claim 4, wherein the location at which said support contacts said hammer is adjacent said hammer fixing portion.

6. A printing head of an impact printer as claimed in claim 4, wherein said hammer fixing portion comprises a yoke supported on said permanent magnet means and to which yoke the first end of said hammer is secured.

* * * * *